US006012962A

United States Patent [19]

Arriola

[11] Patent Number: 6,012,962

[45] Date of Patent: Jan. 11, 2000

[54] TOY FIGURE INSECT HAVING ARTICULATED WINGS AND APPENDAGES

[75] Inventor: Martin F. Arriola, Torrance, Calif.

[73] Assignee: Mattel, Inc., El Segundo, Calif.

[21] Appl. No.: 09/245,986

[22] Filed: Feb. 5, 1999

[51] Int. Cl.[7] ..... A63H 3/46

[52] U.S. Cl. ..... 446/376; 446/330

[58] Field of Search ..... 446/330, 333, 446/335, 376, 377, 380, 383

[56] References Cited

U.S. PATENT DOCUMENTS

| | | | |
|---|---|---|---|
| 3,377,819 | 4/1968 | Joy et al. | 446/376 X |
| 4,031,657 | 6/1977 | Crossman et al. . | |
| 4,125,961 | 11/1978 | Yamashina . | |
| 4,571,206 | 2/1986 | Mayer et al. . | |
| 4,575,045 | 3/1986 | Mayer et al. . | |
| 4,575,349 | 3/1986 | Piazza et al. . | |
| 4,579,542 | 4/1986 | Mayer et al. . | |
| 4,596,532 | 6/1986 | Cook et al. . | |
| 4,601,672 | 7/1986 | Cook et al. . | |
| 4,605,382 | 8/1986 | Cook et al. . | |
| 4,608,026 | 8/1986 | Newton et al. . | |
| 4,610,639 | 9/1986 | Piazza . | |
| 4,654,018 | 3/1987 | Farrington et al. | 446/308 |
| 4,729,748 | 3/1988 | Ruymbeke | 446/376 X |
| 4,988,320 | 1/1991 | Rankin et al. | 446/376 X |
| 5,087,219 | 2/1992 | Price . | |
| 5,458,523 | 10/1995 | Aoki et al. . | |
| 5,588,895 | 12/1996 | Larson | 446/376 X |

*Primary Examiner*—Sam Rimell
*Attorney, Agent, or Firm*—Roy A. Ekstrand

[57] ABSTRACT

A toy figure representing a fanciful insect includes a stable leg and a pivotally supported spring loaded leg which undergoes a kicking motion when a trigger within the figure is released. The figure also supports a plurality of arm appendages and a pair of pivotally supported wings. An internal drive mechanism couples the pivotal motion of the wings as the user squeezes and releases them together and apart to provide erratic motion of the arms.

8 Claims, 4 Drawing Sheets

7
7
96
119
14
125
125
97
14
123
126
120
16
119
96
121
95
127
97
98
118
15
122
13
53
174
51
172
173
150
162
151
161
126
141
140
171
132
120
121
95
118
160
130
11
131
13
170

TOY FIGURE INSECT HAVING ARTICULATED WINGS AND APPENDAGES

FIELD OF THE INVENTION

This invention relates generally to toy figures and particularly to those having action features including articulated limbs or appendages.

BACKGROUND OF THE INVENTION

Toy figures having action features have been well known in the art for many years. Not surprisingly, toy figures have enjoyed great popularity among consumers and as a result have been provided by practitioners in the art in a virtually endless variety. Thus toy figures have been provided which move one limb in response to movement of another limb, move body portions in response to limb movement, or undergo predetermined action moves in response to a movement of one or more limbs. For example, U.S. Pat. No. 4,601,672 issued to Cook et al. sets forth a ACTION FIGURE IN WHICH MANIPULATION OF ONE ARM PRODUCES ROTATION OF BOTH LEGS ABOUT A VERTICAL AXES having a torso coupled to a rotatable leg support and including an internal drive mechanism which converts pivotal movement of a arm to rotational movement of the leg support.

U.S. Pat. No. 4,571,206 issued to Mayer et al. sets forth a ACTION FIGURE WITH WING MOVEMENT DERIVED FROM LEG MOVEMENT having a torso supporting a pair of legs in pivotal attachment together with a pair of pivotally supported wings. The legs are capable of being squeezed together or released to extend outwardly from each other. A drive mechanism within the toy figures torso is operatively coupled to the wings such that squeezing the legs together and releasing them repeatedly causes the wings to flap.

U.S. Pat. No. 4,031,657 issued to Crosman et al. sets forth a ACTION FIGURE having a platform coupled to selected appendages of a toy figure and having a remote movement mechanism operable by the user to manipulate the toy figures action.

U.S. Pat. No. 4,125,961 issued to Yamashina sets forth a DOLL WITH MOVEABLE ARMS, LEGS AND HEAD having a hollow trunk rotatably supporting a head, arms and legs in a rotatable attachment. The limbs are interconnected by a leaf spring.

U.S. Pat. No. 4,578,045 issued to Mayer et al. sets forth an ACTION FIGURE WITH LEG MOVEMENT DERIVED FROM ARM MOVEMENT having a toy figure including a torso supporting a pair of pivotally mounted legs and a pair of pivotally coupled arms. A drive mechanism supports rotational motion of the arms to scissors-like movement of the legs mimicking walking.

U.S. Pat. No. 4,579,542 issued to Mayer et al. sets forth an ACTION FIGURE WITH ARM MOVEMENT DERIVED FROM LEG MOVEMENT having a torso supporting a fixed leg and a pivotally moveable leg together with a pair of arms pivotally supported to the torso.

An elongated coupling rod within the torso converts pivotal movement of the movable leg to rotational movement of a common axle supporting the arms.

U.S. Pat. No. 4,596,532 issued to Cook et al. sets forth an ACTION FIGURE IN WHICH MANIPULATION OF ONE LEG PRODUCES A HORIZONTAL SWINGING OF BOTH ARMS having a toy figure including a torso which pivotally supports a pair of arms. One leg of the figure is fixed in its position upon the torso while the other is pivotable. The pivotable leg is coupled by an elongated arm to a movement mechanism operable upon the toy figures arms such as squeezing the legs together results in swinging of the arms.

U.S. Pat. No. 4,605,382 issued to Cook et al. sets forth a FIGURE WHEREIN LEG MOVEMENT PRODUCES WING-LIKE MOVEMENT OF THE ARMS having an action toy figure including a torso supporting a pair of pivotally joined arms. One leg of the figure is secured to the torso immovably and the other leg is supported in a pivotal attachment. A gear drive mechanism is operable to cause the arms to move simultaneously as a gear rack driven by the pivotable leg is moved.

U.S. Pat. No. 4,608,026 issued to Newton et al. sets forth a FIGURE WHEREIN MANIPULATION OF ONE LIMB CAUSES MOTION OF ANOTHER having a toy figure including a torso supporting a pivotally attached arm. A second arm is fixedly attached. A fixed leg and a pivotally attached leg are also supported on the torso. In operative mechanism within the torso converts pivotal motion of the leg to pivotal motion of the arm.

U.S. Pat. No. 5,087,219 issued to Price sets forth an ACTION CHARACTER FIGURE having a telescoping body which allows the figure to contract and expand in the vertical direction.

U.S. Pat. No. 5,458,523 issued to Aoki et al. sets forth an ACTION CHARACTER FIGURE ASSEMBLY having an elongated housing defining a pedestal supporting an articulated toy figure and a handle manipulatable by the user. An operative mechanism between the handle and the toy figure allows the user to manipulate the toy figure somewhat remotely.

U.S. Pat. No. 4,575,349 issued to Piazza et al. and entitled WINGED CREATURE and U.S. Pat. No. 4,610,639 issued to Piazza and entitled SIMULATED FLYING CREATURE WITH FLAPABLE WINGS sets forth examples of toy figures having articulated wings.

While the foregoing described prior art devices have improved the art and in some instances enjoyed commercial success there remains nonetheless a continuing need in the art for ever more interesting, exciting, amusing and entertaining action toy figures.

SUMMARY OF THE INVENTION

Accordingly, it is a general object of the present invention to provide an improved action toy figure. It is a more particular object of the present invention to provide an improved action toy figure which presents a pair of action figures independently operated on a common figure.

In accordance with the present invention there is provided a toy figure comprising: a body having an interior cavity; a pair of wings pivotally coupled to the body and having a pair of engaging gears to provide inward and outward scissors-like pivotal movement; a first pair of arms on opposite sides of the body and a first rotatable shaft therebetween, the first rotatable shaft having a first cam follower; a second pair of arms on opposite sides of the body and a second rotatable shaft therebetween, the second rotatable shaft having a second cam follower, and a cam rotatably engaging one of the gears having a plurality of cam lobes pivoting the first and second rotatable shafts as the wings are moved toward each other and away from each other.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENT

Figure 1:
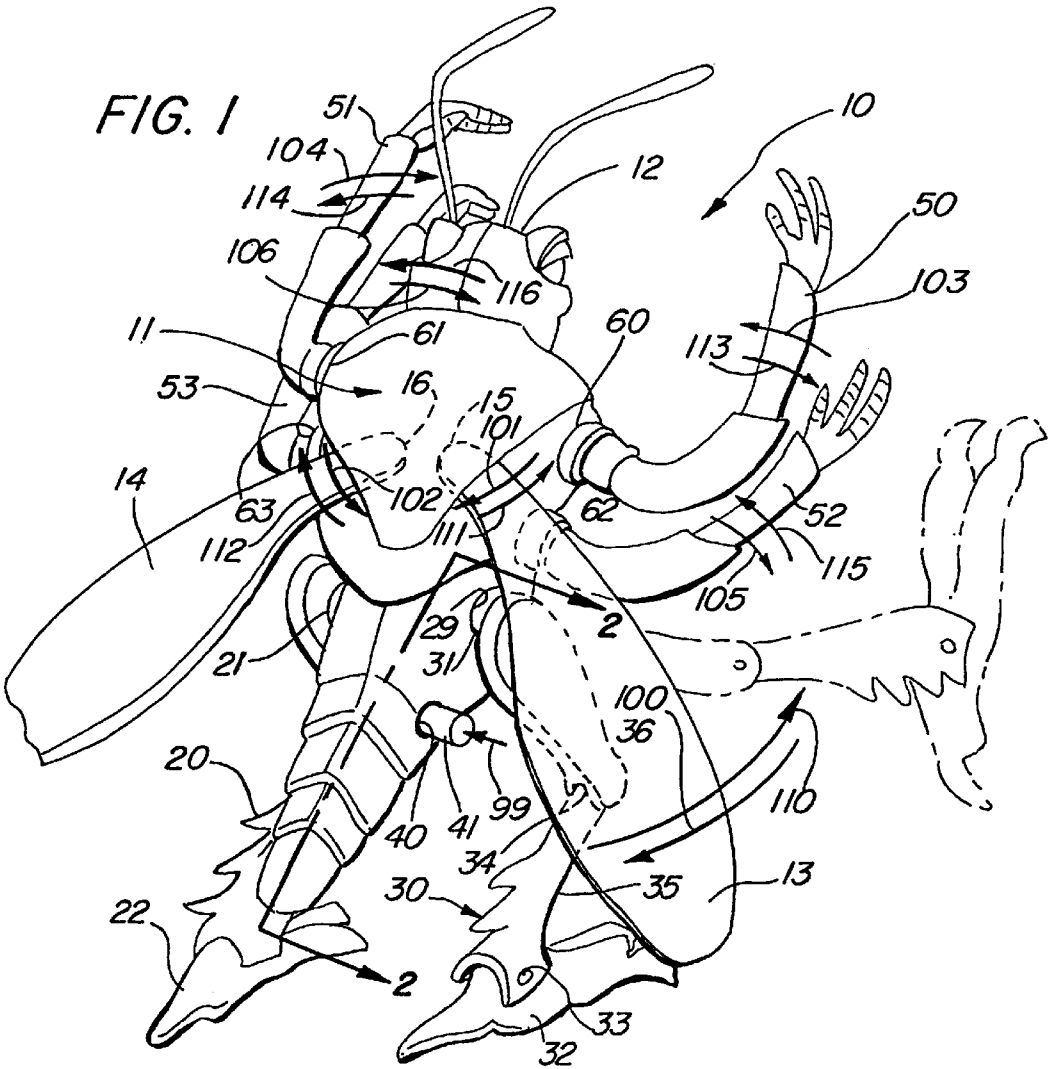
FIG. 1 sets forth a rear perspective view of a toy figure constructed in accordance with the present invention.
Figures 5, 6, 7:
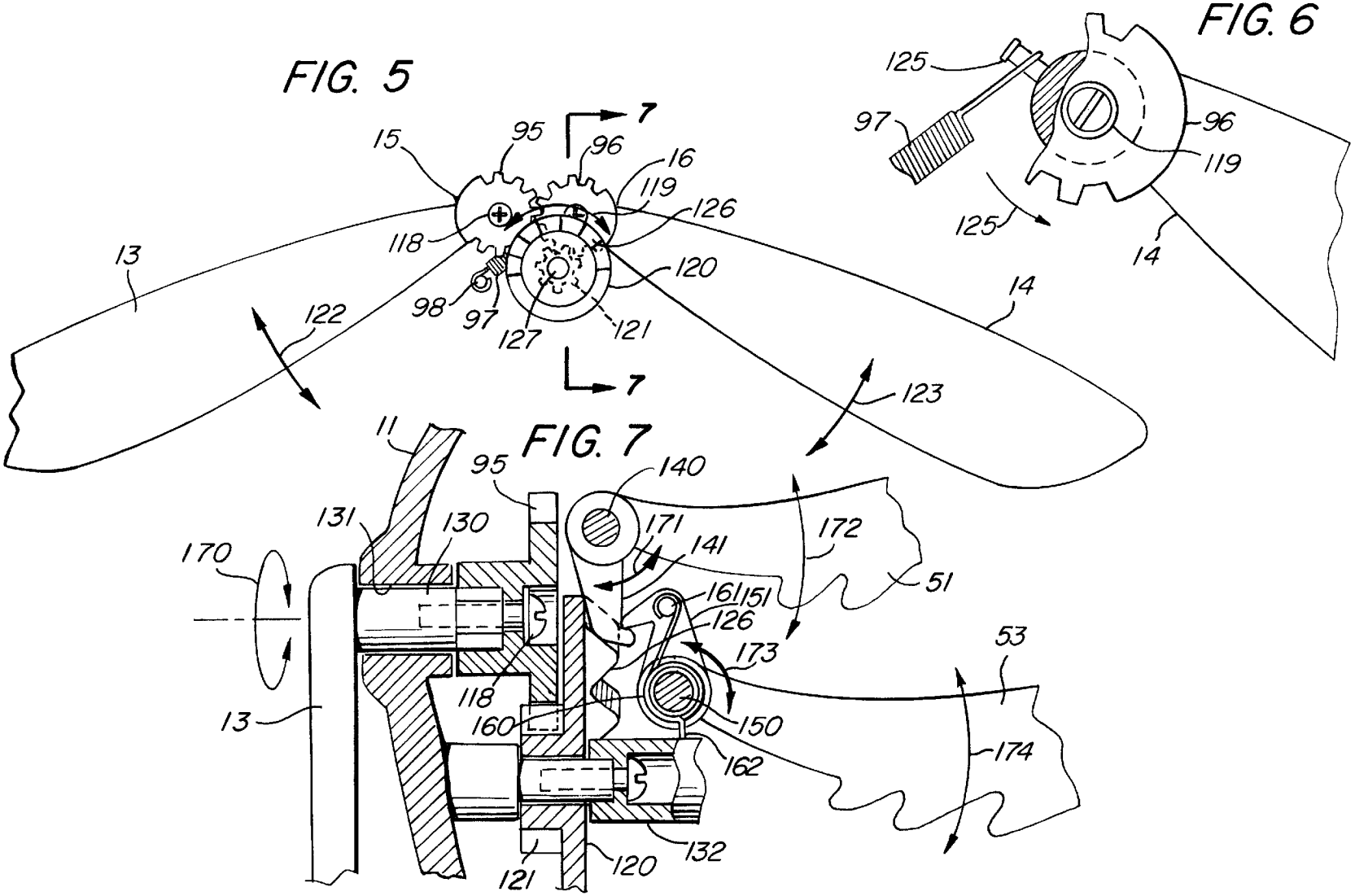
FIG. 5 sets forth an assembly view of the wing drive mechanism of the present invention toy figure.
FIG. 6 sets forth a partial section view of the drive string attachment for the present invention toy figures wings.
FIG. 7 sets forth a partial section view of the arm drive mechanism of the present invention toy figure.

FIG. 1 sets forth a rear perspective view of a toy figure constructed in accordance with the present invention and generally referenced by numeral 10. Toy FIG. 10 includes a body 11 resembling a fanciful depiction of an insect body such as a grasshopper or the like. Body 11 is preferably formed of a molded plastic material or the like and supports a head 12 and a pair of wings 13 and 14. Wings 13 and 14 define respective ends 15 and 16 which as is set forth below in FIG. 5 are pivotally secured to body 11. Suffice it to note here that wings 13 and 14 are pivotally moveable. Toy FIG. 10 further includes a pair of upper arms 50 and 51 secured to body 11 at a pair of pivot joints 60 and 61 respectively. In addition, toy FIG. 10 includes a pair of lower arms 52 and 53 pivotally secured to body 11 at a pair of pivot joints 62 and 63 respectively. A leg 20 including a foot 22 is pivotally joined to body 11 at a joint 21. A leg 30 includes a foot 32 and a lower leg 35 joined at a pivotal joint 33. Leg 30 further includes an upper leg 36 pivotally joined to lower leg 35 at a joint 34. Upper leg 36 is further joined to body 11 at a joint 31 which as described below in greater detail facilitates pivotal kicking movement to a raised position shown in dash-line representation. In contrast, in the preferred fabrication of the present invention leg 20 is a non-articulated leg and is therefore able to provide support for toy FIG. 10 during the kicking action of leg 30 described below.

Body 11 further defines an aperture 40 which receives a push button 41 operative in the manner set forth below in FIGS. 2 through 4 to release the kicking action of the toy figure.

Figure 2:
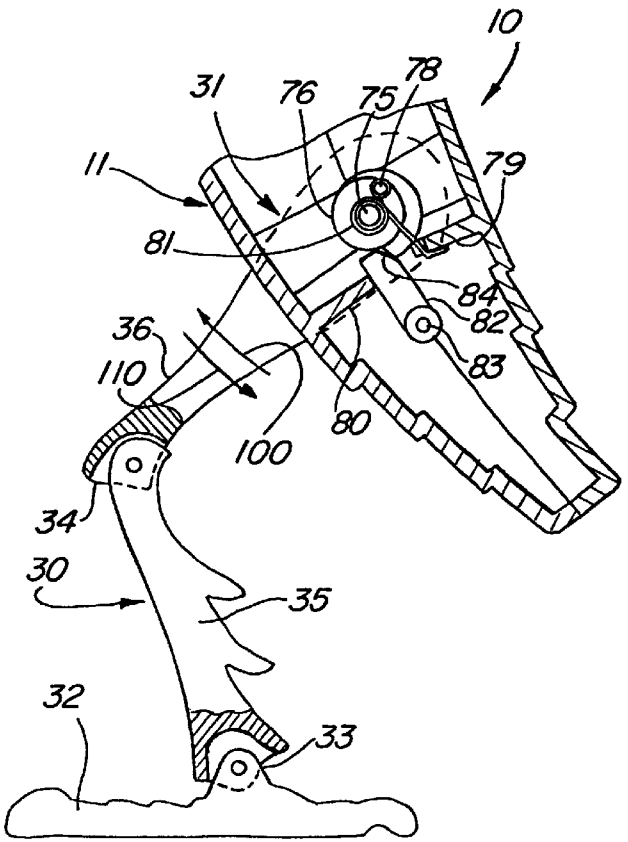
FIG. 2 sets forth a partial section view of the present invention toy figure taken along section lines 2—2 in FIG. 1.
Figure 3:
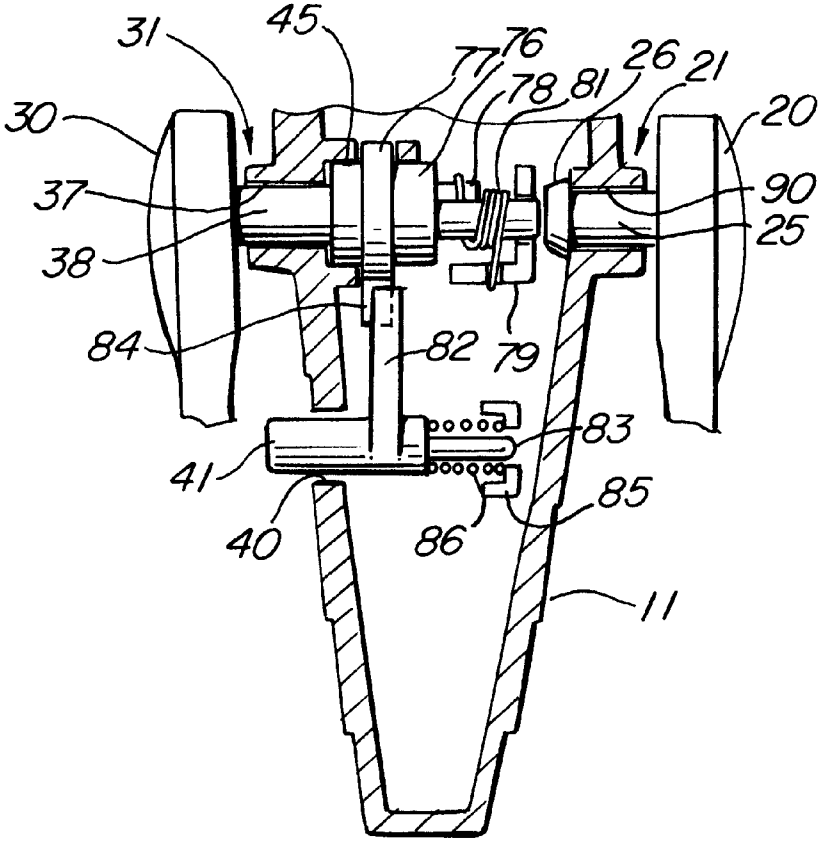
FIG. 3 sets forth a partial section view of the leg drive mechanism of the present invention toy figure.

In operation, toy FIG. 10 provides two independent spring driven play features one of which is operable upon leg 30 to provide a kicking action and is described in FIGS. 2 through 3 in greater detail. The other operative feature responds to the pivotal movement of wings 13 and 14 to produce arm movement of the figure and is described below in FIGS. 5 through 9. With the exception of the springs which are made of appropriate spring metal, the entire toy figure may be fabricated of low cost high volume molded plastic components or the like. It will also be understood by those skilled in the art that while toy FIG. 10 is presented with an appearance generally resembling a fanciful grasshopper like character, other appearances may be utilized without parting from the spirit and scope of the present invention.

More specifically, the operation of the kicking feature of toy FIG. 10 proceeds as the user pivots leg 30 downwardly in the direction indicated by arrow 100 to the solid line position shown. In this position a trigger mechanism supported within body 11 (seen in FIG. 2) latches leg 30 downwardly against an internal spring. The kicking action of toy FIG. 10 is initiated by resting toy FIG. 10 upon foot 22 and pressing button 41 inwardly in the direction indicated by arrow 99. By means set forth below in FIGS. 2 through 4 the inward movement of button 41 releases the trigger holding leg 30 allowing leg 30 to pivot upwardly and forwardly in a rapid motion in the direction of arrow 110. This feature may be repeated as often as the user likes. During the operation of this feature the articulation of foot 32, lower leg 35 and upper leg 36 provides a more realistic kick motion.

The operation of the additional feature in which arms 50 through 53 are rapidly moved in a up and down pivoting motion is carried forward as the user applies scissors-like squeezing to wings 13 and 14. Thus as the user squeezes wings 13 and 14 inwardly in the directions indicated by arrows 101 and 102, the gear and cam mechanism within body 11 shown in FIGS. 5 through 7 moves arms 50 and 51 upwardly in the directions indicated by arrow 103 and 104 while simultaneously moving lower arms 52 and 53 downwardly in the directions indicated by arrows 105 and 106. This motion continues until wings 13 and 14 are brought together at this time the user then releases wings 13 and 14 allowing an internal return spring (seen in FIG. 5) to pivot wings 13 and 14 outwardly in the directions indicated by arrows 111 and 112. The outward pivotal motion of wings 13 and 14 causes upper arms 50 and 51 to pivot downwardly in the direction indicated by arrow 113 and 114 and to simultaneously pivot lower arms 52 and 53 upwardly in the direction indicated by arrows 115 and 116. As a result, as the user repeatedly squeezes and releases wings 13 and 14 in a scissors-like manner arms 50 through 53 move rapidly through pivotal motions in opposite directions to give the appearance of a agitated or excited insect consistent with the "warrior theme" of FIG. 10.

FIG. 2 sets forth a partially sectioned side view of the operative mechanism controlling leg 30. Toy FIG. 10 includes a body 11 to which a leg 30 is pivotally secured. As described above, leg 30 includes a foot 32 pivotally coupled to a lower leg 35 at a joint 33. Lower leg 35 is further coupled to an upper leg 36 at a knee joint 34. It will be noted from the section views of FIG. 2 that joints 33 and 34 cooperate to limit the travel of upper leg 36 and lower leg 35 together with foot 32 to a realistic range of motions.

As described above, upper leg 36 is pivotally secured at body 11 at a joint 31. Joint 31 includes a shaft 75 extending inwardly through an aperture 29 (seen in FIG. 1). Shaft 75 supports a coil spring 81 having one end secured to an internal plate 79 of body 11. Shaft 75 further supports a baring 76 and a cam 77. Cam 77 includes a lock edge 84. Baring 76 further includes a pin 78 which receives the remaining end of spring 81. Spring 81 is stressed within body 11 and provides a spring force urging leg 30 toward upward pivotal motion in the direction indicated by arrow 100.

A trigger mechanism 82 is supported upon a post 83 within body 11 and is prevented from pivoting forwardly by the extension of plate 80. Thus as is better seen in FIGS. 3 and 4, trigger 82 is movable between a locking position shown in FIG. 2 in which trigger 82 engages edge 84 and prevents rotation of leg 30 and a release position shown in FIG. 4. The important element of trigger 82 is the conversion of the inward force of button 41 (seen in FIG. 1) to the release of leg 30 allowing the stored energy within spring 81 to rapidly pivot leg 30 upwardly in the direction of arrow 100. As this pivoting takes place, upper leg 36 leads initially with lower leg 35 and foot 32 following due to their pivotal attachments. Once upper leg 36 reaches its upper most travel the momentum in lower leg 35 and foot 32 causes the bent leg to rapidly straighten giving a realistic action. Leg 30 is cocked or reloaded by pivoting upper leg 36 downwardly in the direction indicated by arrow 110 until cam 77 again engages trigger 82 at edge 84.

Figure 4:
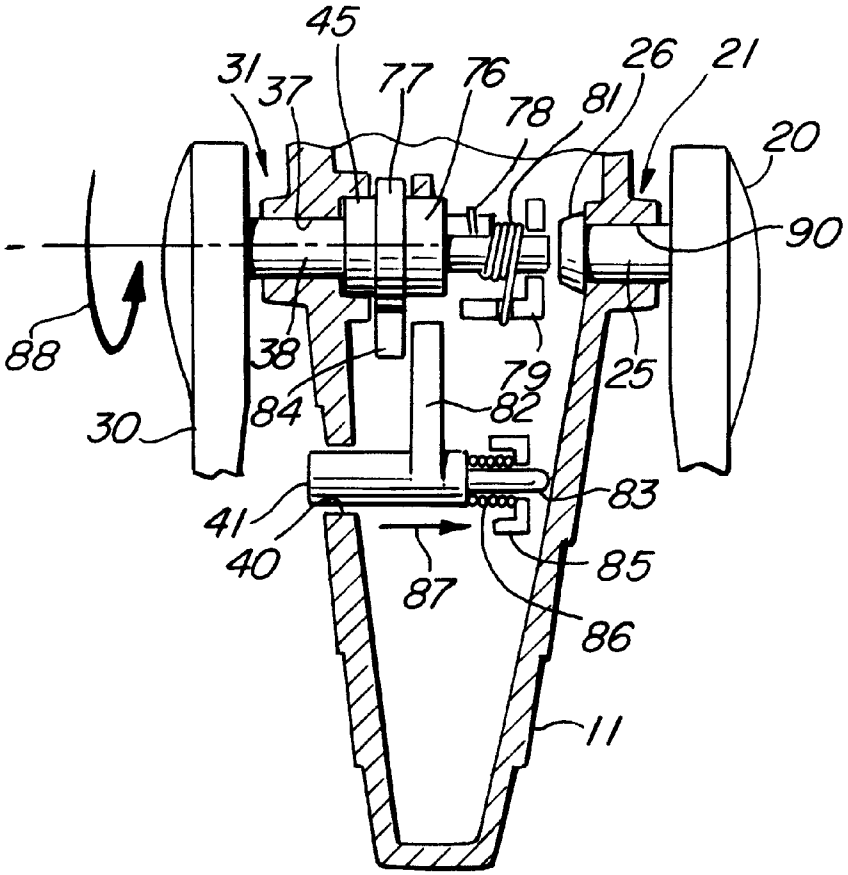
FIG. 4 sets forth a partial section view of the leg drive mechanism of the present invention following release of the trigger.

FIGS. 3 and 4 set forth similar section views of the leg locking portion of the present invention toy figure. FIG. 3 shows the leg mechanism in its cocked or loaded position while FIG. 4 shows the same mechanism in its released position allowing the figure to execute a kick.

More specifically, toy FIG. 10 includes a body 11 having an aperture 90 receiving a post 25 of leg 20. Post 25 includes an enlarged head 26 securing leg 20. In the preferred fabrication of the present invention, leg 20 is pivotable but does not have any active feature and thus can support stable support for the toy figure when held by the user during the kicking action.

Body 11 further defines an aperture 37 having a shaft 38 extending therethrough. Shaft 38 is joined to leg 30 and includes a coupler 35 which operatively couples shaft 38 to a cam 77. Cam 37 includes a locking edge 84 and is joined to a cylindrical baring 76. A spring 81 is wound upon the shaft of baring 76 and is secured at one end to a pin 78 and at the remaining end to a plate 79. Plate 79 is formed within body 11.

A trigger 82 is supported within body 11 by a push button 41 which in turn is slidably received within an aperture 40 formed in body 11. Trigger 82 further includes a spring 86 and a post 83. Post 83 and spring 86 cooperate to provide a spring force against button 41 urging it outwardly. The force of spring 86 is asserted against an internal bracket 85 of body 11. In the locked position shown in FIG. 3, leg 30 has been rotated against spring 81 until trigger 82 which it will be recalled is moveable laterally and is urged by spring 86 to the position shown in which trigger 82 engages edge 84. Returning to FIG. 2 for the moment, it will be noted that plate 80 is positioned to prevent the movement of trigger 82 away from edge 84. Thus at this point the kicking mechanism operative upon leg 30 and having energy stored in spring 81 is locked.

FIG. 4 shows the same section view as FIG. 3 with the difference being the movement of the trigger towards actuation of the kicking action thus in FIG. 4 it will be noted that button 41 has been pushed inwardly against spring 86 in the direction indicated by arrow 87 moving trigger 82 out of the way and releasing cam 77.

More specifically, toy FIG. 10 includes a body 11 having an aperture 90 receiving a post 25 of leg 20. Post 25 includes an enlarged head 26 securing leg 20. In the preferred fabrication of the present invention, leg 20 is pivotable but does not have any active feature and thus can support stable support for the toy figure when held by the user during the kicking action.

Body 11 further defines an aperture 37 having a shaft 38 extending therethrough. Shaft 38 is joined to leg 30 and includes a coupler 35 which operatively couples shaft 38 to a cam 77. Cam 37 includes a locking edge 84 and is joined to a cylindrical baring 76. A spring 81 is wound upon the shaft of baring 76 and is secured at one end to a pin 78 and at the remaining end to a plate 79. Plate 79 is formed within body 11.

A trigger 82 is supported within body 11 by a push button 41 which in turn is slidably received within an aperture 40 formed in body 11. Trigger 82 further includes a spring 86 and a post 83. Post 83 and spring 86 cooperate to provide a spring force against button 41 urging it outwardly. The force of spring 86 is asserted against an internal bracket 85 of body 11.

Once trigger 82 is moved away from edge 84 the energy stored in spring 81 is released causing baring 76, cam 77, coupler 45 and shaft 38 to rapidly pivot leg 30 upwardly and forwardly in the direction indicated by arrow 88. At the completion of a kick action, spring 86 returns trigger 82 to the extended position shown in FIG. 3 and the user can reload and cock the leg action by simply pivoting leg 30 in the opposite direction of arrow 88 to store energy in spring 81 and lock cam 77 in the position shown in FIG. 3. Thus using the leg kicking feature of the present invention, the user learns to support toy FIG. 10 upon leg 20 while exercising the kicking action.

FIG. 5 sets forth a front view of the wing drive mechanism of the present invention toy figure. As mentioned above, wings 13 and 14 are pivotally secured to body 11. FIG. 5 shows this pivotal attachment having a pair of cooperating engaged gears 95 and 96 having posts 118 and 119 pivotally securing gears 95 and 96. In the embodiment of the present invention shown in FIG. 5 posts 18 and 19 are provided by threaded fasteners. However, other apparatus may be used to pivotally secure gears 95 and 96. The engagement of gears 95 and 96 causes wings 13 and 14 to pivot in the directions indicated by arrows 122 and 123 in a scissors-like action. A spring 97 is secured at one end to a post 98 formed within body 11 (not shown) and has its remaining end secured to gear 96 in the manner shown in FIG. 6.

A cam 120 having a plurality of cam lobes 126 is rotatably supported within body 11 by a post 127. Cam 120 includes a integrally formed gear 121 also rotatable upon post 127 which engages gear 96.

In operation, the user is able to manipulate wings 13 and 14 in a scissors-like action squeezing and releasing wings 13 and 14 against the force of spring 97. Spring 97 acts to urge wings 13 and 14 to their spread position. The scissors-like motion of wings 13 and 14 produces a back-and-forth pivotal movement of cam 120 in the manner indicated by arrows 124.

FIG. 6 shows a partial section view of the spring coupling of spring 97 to gear 96. Thus wing 14 and gear 96 are integrally formed and are pivotable upon post 119. Gear 96 further includes a post 125 which receives one end of spring 97. Thus when spring 97 is stretched such as occurs by the inward squeezing movement above, spring 97 stores energy urging gear 96 and wing 14 outwardly in the direction indicated by arrow 125. The above described coupling between gear 96 of wing 14 and gear 95 of wing 13 results in spreading both wings outwardly.

FIG. 7 set forth a partial section side view of the arm drive mechanism of the present invention. As described above, body 11 pivotally supports wing 13 as shown in FIG. 5. Thus body 11 defines an aperture 131 within which a shaft 130 extending inwardly from wing 13 is supported. Shaft 130 is coupled to a gear 95 by a fastener 118. It will be recalled that wing 13 is pivotable together with gear 95 about fastener 118. It will be further recalled with reference to FIG. 5 that gear 95 engages gear 96 which in turn pivotally supports wing 14.

Returning to FIG. 7, a cam 120 having a gear 121 engages gear 95 and is pivotable therewith. Cam 120 includes a plurality of triangular shaped cam lobes 126. A post 132 is formed in body 11 and operates to support cam 120.

Figure 8:
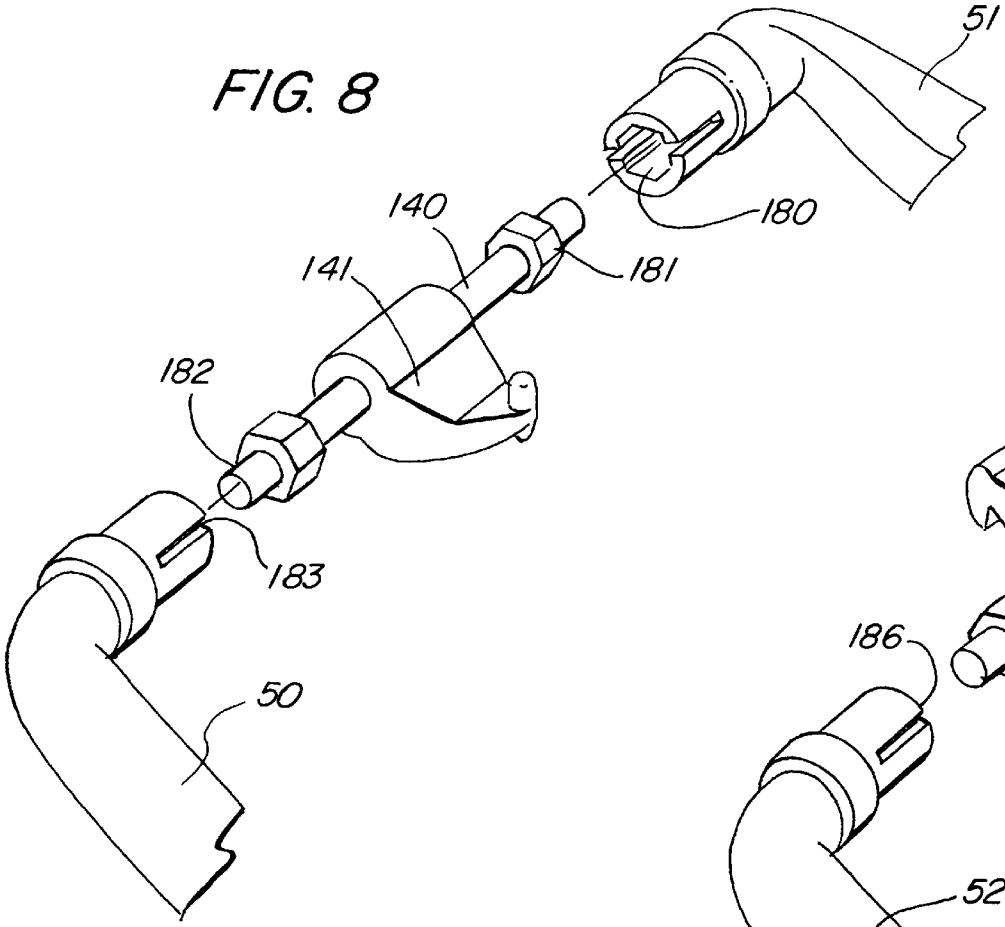
FIG. 8 sets forth a perspective assembly view of the upper arm pair coupling shaft and cam.

An upper arm shaft 140 shown in perspective assembly in FIG. 8 supports arm 51 together with a cam follower 141. A lower arm shaft 150 shown in perspective assembly view in FIG. 9 supports a cam follower 151 having a pin 161 thereon and being joined to arm 53. A spring 160 is received upon lower arm shaft 150 and is coupled between pin 161 and a static connection 162. Spring 160 provides a spring force urging cam follower 151 against cam follower 141.

In operation, as wing 13 is pivoted in the directions indicated by arrows 170, gear 95 causes cam 120 to pivot correspondingly through the engagement of gears 95 and 121. It will be noted that this gear engagement causes the pivotal motion to be opposite to the pivotal motion of wing 13. As cam 120 rotates, cam follower is alternately urges outwardly then inwardly by cam lobes 126 passing beneath cam follower 141. The pivotal motion of cam follower 141 in the directions indicated by arrows 171 produce pivotal motions 172 of arm 51. In addition, cam follower 141 in following cam lobes 126 pivots cam follower 151 outwardly and inwardly in the direction indicated by arrows 173. The pivotal motion of cam follower 151 is resisted by spring 160 and as cam 120 rotates arm 53 is pivoted up and down in the direction indicated by arrow 174. It will be noted that the pivotal movements of arms 51 and 53 are opposite in direction such that arm 51 pivots up and down arm 53 pivots down and then up.

FIG. 8 sets forth a perspective assembly view of the upper arm mechanism of the present invention. Thus upper arm shaft 140 includes a cam follower 141 and a pair of clutch plugs 181 and 182. Correspondingly, arm 51 includes a clutch socket 180 which receives plug 181 while arm 50 includes a clutch socket 183 which receives plug 182. Thus arm shaft 140 in response to cam follower 141 provides movement of arms 50 and 51 in unison.

Figure 9:
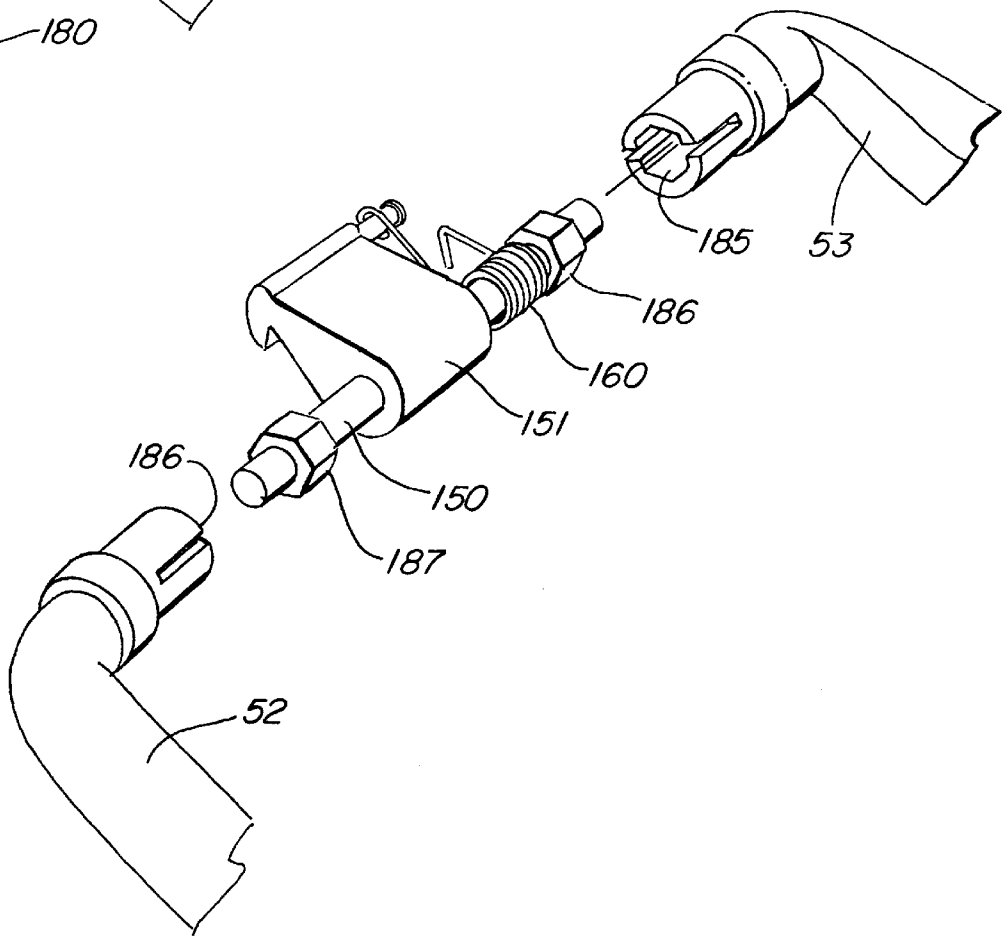
FIG. 9 sets forth a perspective assembly view of the lower arm pair coupling shaft and cam.

FIG. 9 sets forth a perspective assembly view of the lower arm support mechanism of toy FIG. 10. As described above, a lower arm shaft 150 supports a cam follower 151 having a return spring 160 supported thereon. Shaft 150 supports a pair of fastened clutch plugs 186 and 187 at opposite ends thereof. Arms 52 and 53 define respective clutch sockets 188 and 185 which are received upon plugs 187 and 186 respectively. As a result arms 52 and 53 are moved in unison in response to pivotal movement of cam follower 151 in the manner described below in FIG. 7.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. A toy figure comprising:

a body having an interior cavity;

a pair of wings pivotally coupled to said body and having a pair of engaging gears to provide inward and outward scissors-like pivotal movement;

a first pair of arms on opposite sides of said body and a first rotatable shaft therebetween, said first rotatable shaft having a first cam follower;

a second pair of arms on opposite sides of said body and a second rotatable shaft therebetween, said second rotatable shaft having a second cam follower, and a cam rotatably engaging one of said gears having a plurality of cam lobes pivoting said first and second rotatable shafts as said wings are moved toward each other and away from each other.

2. The toy figure set forth in claim 1 further including:

a first leg joined to said body and having a first supporting foot;

a second leg pivotally joined to said body hand having a second supporting foot;

a spring urging said second leg toward a raised forwardly extending position; and a trigger means having a latch for latching said second leg in a downward position, said second leg being pivotable downwardly against said spring to store energy therein and latched by said trigger means, said latch being releasable to allow said spring to rapidly pivot said second leg upwardly.

3. The toy figure set forth in claim 2 wherein said second leg include an ankle joint and a knee joint each freely pivotable.

4. The toy figure set forth in claim 3 wherein said ankle joint and said knee joint include pivot range limiting stops.

5. The toy figure set forth in claim 4 wherein said first and second pairs of arms move oppositely as said cam pivots.

6. The toy figure set forth in claim 5 wherein said toy figure resembles a fanciful grasshopper.

7. The toy figure set forth in claim 1 wherein said toy figure resembles a fanciful grasshopper.

8. The toy figure set forth in claim 7 wherein said first and second pairs of arms move oppositely as said cam pivots.

* * * * *